United States Patent [19]

Kraw, Jr.

[11] 4,274,377

[45] Jun. 23, 1981

[54] VACUUM RESPONSIVE CARBURETOR LINKAGE

[76] Inventor: Stanley P. Kraw, Jr., 7403 S. 48th St., Omaha, Nebr. 68157

[21] Appl. No.: 144,246

[22] Filed: Apr. 28, 1980

[51] Int. Cl.[3] ..... F02B 11/08

[52] U.S. Cl. ..... 123/396; 123/340; 123/389

[58] Field of Search ..... 123/97 R, 103 R, 103 C, 123/103 E, 378, 389, 396, 340

[56] References Cited

U.S. PATENT DOCUMENTS

| | | | |
|---|---|---|---|
| 2,527,354 | 10/1950 | Christian | 123/103 R |
| 2,529,437 | 11/1950 | Weinberger | 123/103 C |
| 3,289,659 | 12/1966 | Koole | 123/103 C |
| 4,046,117 | 9/1977 | Brinlee | 123/103 C |

FOREIGN PATENT DOCUMENTS

| | | | |
|---|---|---|---|
| 905559 | 3/1954 | Fed. Rep. of Germany | 123/103 C |

*Primary Examiner*—Craig R. Feinberg

*Attorney, Agent, or Firm*—Zarley, McKee, Thomte, Voorhees & Sease

[57] ABSTRACT

A vacuum responsive carburetor linkage includes a housing at least partially defining a vacuum chamber therein and an end wall further defining the vacuum chamber and movable relative to the housing between extended and retracted positions whereby the chamber is extended and retracted. The housing is connected to either the accelerator pedal linkage or carburetor throttle lever and the end wall is connected to the other of the accelerator pedal linkage or carburetor throttle lever. A vacuum conduit establishes communication between the vacuum chamber and a vacuum source in the carburetor of the internal combustion engine. Thus when the carburetor vacuum is low, lost motion is permitted between the accelerator pedal linkage and carburetor throttle lever whereas when the carburetor vacuum is high, the carburetor throttle lever is moved in substantially direct response with the accelerator pedal linkage.

5 Claims, 5 Drawing Figures

VACUUM RESPONSIVE CARBURETOR LINKAGE

BACKGROUND OF THE INVENTION

The present invention is directed to a vacuum responsive linkage between the accelerator pedal and carburetor throttle lever of an automotive vehicle whereby lost motion is permitted between the accelerator pedal linkage and carburetor throttle lever when the carburetor vacuum drops off in response to the engine being placed under a load with the result that the engine is capable of sustaining a higher vacuum for increased fuel efficiency.

This invention is based on the principle that the vacuum generated in the carburetor of an internal combustion engine decreases as a greater load is placed on the engine. Furthermore, the fuel efficiency of a given internal combustion engine is generally proportional to the level of vacuum in the carburetor. Upon applying these principles to an automotive vehicle, it can be seen that fuel efficiency is greatest and the carburetor vacuum is high when the vehicle is proceeding at a steady rate or accelerating only moderately. However, when a jackrabbit start is attempted from a standing stop or when a vehicle is suddenly accelerated, the engine is placed under great load, the vacuum drops off and a considerable quantity of fuel is consumed.

A problem of conventional automobiles is that the responsibility for fuel efficiency is placed entirely on the operator since the engine is readily capable of consuming excess fuel when an operator employs poor driving habits. Accordingly, there is a need for a device which may be installed on existing vehicle engines which will ensure fuel efficient operation regardless of the particular driving habits of an operator.

Accordingly, a primary object of the present invention is to provide a vacuum responsive linkage between the accelerator pedal and carburetor throttle lever of an automotive vehicle.

Another object is to provide such a vacuum responsive carburetor linkage which will ensure a high vacuum and thus fuel efficient operation of a vehicle engine at all times.

Another object is to provide such a vacuum responsive carburetor linkage which enables a vehicle engine to be immediately responsive to movements of the accelerator pedal linkage yet which permits sustained acceleration only at a rate at which the carburetor vacuum is maintained at a predetermined level.

Another object is to provide a vacuum responsive carburetor linkage which is operative to provide a substantially direct connection between the accelerator pedal linkage and carburetor throttle level when the engine is inoperative or being started.

A further object is to provide a vacuum responsive carburetor linkage which is adapted to improve the inherent fuel efficiency of any internal combustion engine.

Finally, an object is to provide a vacuum responsive carburetor linkage which is economical to manufacture, simple in construction and efficient in operation.

SUMMARY OF THE INVENTION

The vacuum responsive carburetor linkage of the present invention includes a housing which at least partially defines a vacuum chamber therein and an end wall which further defines the vacuum chamber and which is movable relative to the housing between extended and retracted positions wherein the vacuum chamber is extended and retracted respectively. The housing is adapted to be connected to either the accelerator pedal linkage or the carburetor throttle lever and the end wall is adapted for connection to the other of the accelerator pedal linkage or carburetor throttle lever. A vacuum conduit provides communication between the vacuum chamber and a vacuum source in the carburetor of the engine. Accordingly, when the carburetor vacuum is low, lost motion is permitted between the accelerator pedal linkage and carburetor throttle lever allowing the engine to recover its vacuum and regain the fuel efficiency associated with its operation when the carburetor vacuum is high. Under high vacuum, the end wall is urged toward its retracted position for substantially direct movement of the carburetor throttle linkage in response to movement of the accelerator pedal linkage. A stationary baffle may be installed within the vacuum chamber between the closed end thereof and the end wall for regulating relative movement between the end wall and housing. The vacuum chamber may contain a liquid which freezes at moderate ambient temperatures so as to assure direct response of the carburetor throttle lever to the accelerator pedal linkage when the engine is being started and before the engine is warmed up. Alternatively, or in addition, a valve may be interposed along the vacuum conduit for the same purpose.

DESCRIPTION OF THE PREFERRED EMBODIMENT

Figure 1:
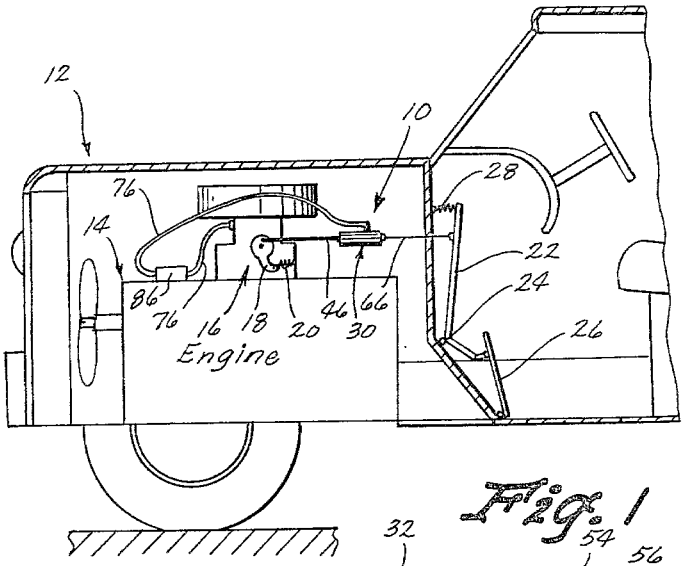
FIG. 1 is a diagrammatic view showing the vacuum responsive linkage installed on an automobile engine.

The vacuum responsive carburetor linkage 10 is shown in FIG. 1 installed in an automotive vehicle 12 which includes an internal combustion engine 14 equipped with a carburetor 16. A conventional carburetor throttle lever 18, equipped with return spring 20, is connected by the linkage 10 to the accelerator pedal linkage 22. Linkage 22 is pivoted at 24 in a clockwise direction in response to depressing movement of the accelerator pedal 26 and is pivoted in a counterclockwise direction by return spring 28 when pressure is removed from the accelerator pedal 26.

Figure 2:
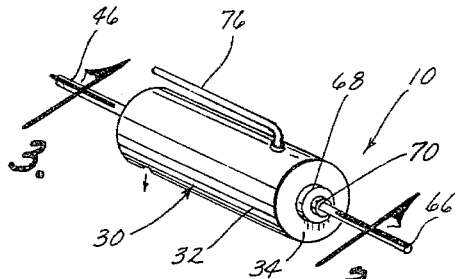
FIG. 2 is a perspective view of the device.
Figure 3:
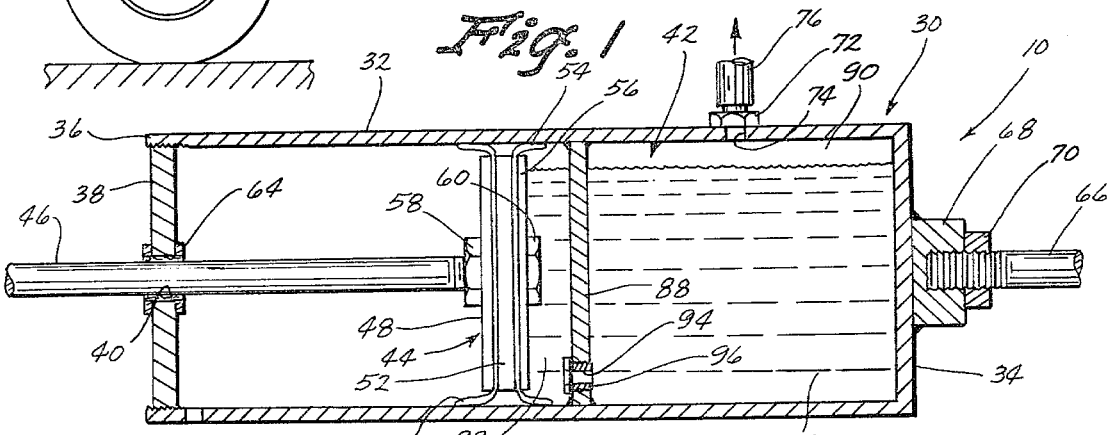
FIG. 3 is an enlarged sectional view taken along line 3—3.

Referring to FIGS. 2 and 3, the vacuum responsive linkage 10 includes an elongated housing 30 having a generally tubular sidewall 32 and one closed end 34. The opposite end 36 is opened but is adapted to be closed by an externally threaded washer 38 having a central opening 40 for a purpose described hereinbelow.

Housing 30 at least partially defines a vacuum chamber indicated generally at 42, which chamber is further defined by a movable end wall or piston 44 which is axially movable within the housing in sealed relation with the sidewall 32. A first elongated rod 46 is connected at one end to the piston 44 and connected at the other end to the carburetor throttle lever 18 for rotating the lever 18 in response to axial movements of piston 44.

In the embodiment shown in the drawings, piston 44 comprises an assembly of an external washer 48, a first hydraulic cup 50, a center washer 52, a second hydraulic cup 54 and an interior washer 56 which are sandwiched between a pair of locknuts 58 and 60 on a threaded end portion 62 of first rod 46. The hydraulic cups 50 and 54 are arranged in back-to-back relation so as to provide an effective seal with the housing sidewall 32 as the piston is moved in opposite directions. It is seen that the first rod 46 is extended through an appropriate seal 64 installed in the opening 40 of end washer 38.

Whereas the piston 44 is connected by first rod 46 to the carburetor throttle lever 18, the housing 30 is connected by a second lever 66 to the accelerator pedal linkage 22 for axial movement of the housing in response to pivotal movement of the accelerator pedal linkage. In FIG. 3, it is seen that a nut 68 is fixed on the housing end wall 34 and that the second rod 66 is threaded into nut 68 and secured therein by locknut 70.

A vacuum nipple 72 is installed in an opening 74 through housing sidewall 32. A vacuum tube or conduit 76 is fitted at one end onto the nipple 72 and connected at the other end to the engine carburetor 16 for establishing communication between vacuum chamber 42 and the vacuum source within the carburetor.

Figure 4:
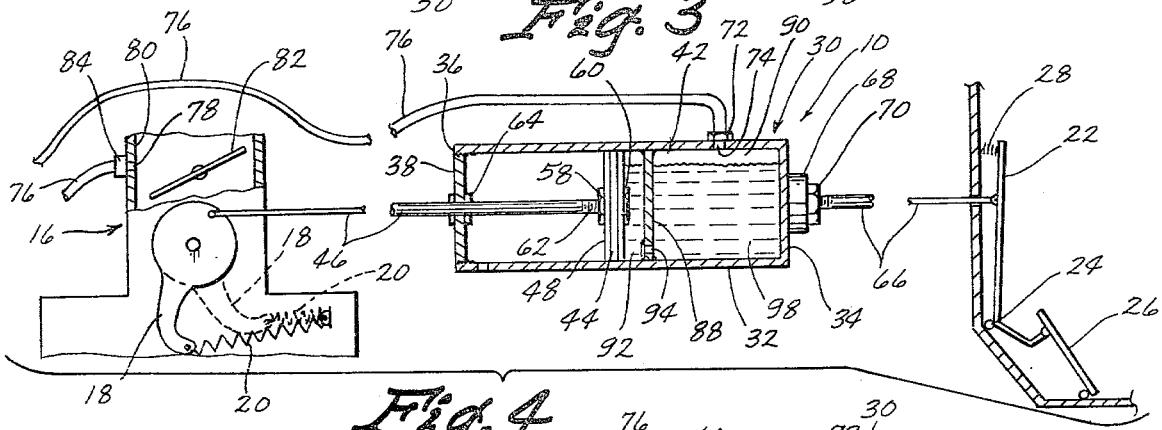
FIG. 4 is an enlarged foreshortened partially sectional view of the device as operatively assembled with the carburetor and accelerator pedal of the vehicle.

In FIG. 4, it is seen that an opening 78 is provided in the throat 80 of the carburetor 16 at a position immediately above the butterfly or throttle valve 82. An appropriate fitting 84 in opening 78 is adapted for connection to the opposite end of vacuum tube 76. The position of opening 78 above the throttle valve 82 is advantageous in that the vacuum surges which occur below the throttle valve are substantially avoided.

A valve 86 is shown in FIG. 1 as interposed along the vacuum tube 76. The valve 86 is adapted to be closed when the engine is inoperative or being started, for a purpose described hereinbelow. In the preferred embodiment, valve 86 includes a heat responsive switch which actuates a solenoid to electrically open the valve when the engine warms up. Such a valve is commercially available from General Motors as Chevrolet Part No. 114434. The valve may be mounted on the intake manifold of the engine 14 in front of the carburetor 16 where it will be responsive to engine temperature.

A stationary baffle 88 is installed within housing 30 to subdivide the vacuum chamber 42 into a first fixed volume chamber 90 and a second variable volume chamber 92 depending upon the position of piston 44. An orifice opening 94 adjacent the lower edge of baffle 88 affords communication between the chambers 90 and 92. Orifice 94 is preferably formed as an externally threaded replaceable orifice element 96 installed in a threaded opening in the baffle 88.

Figure 5:
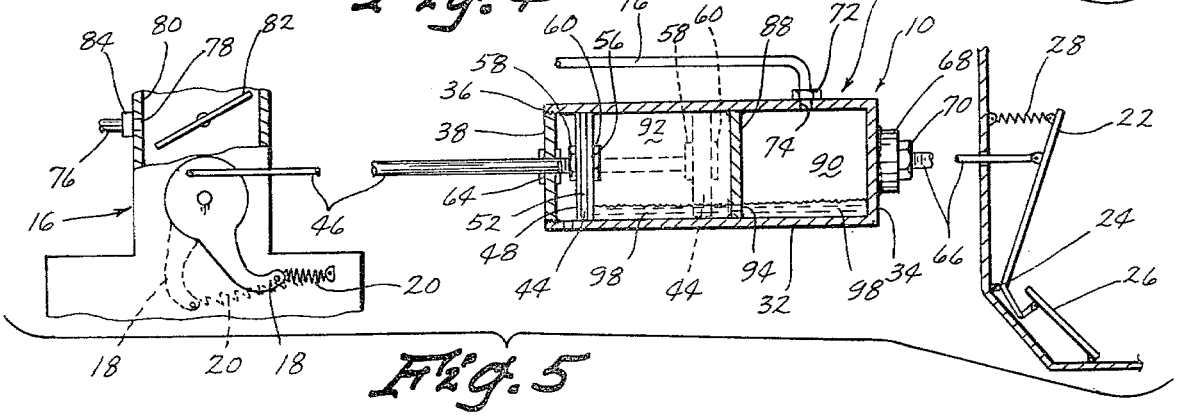
FIG. 5 is similar to FIG. 4 but with the vacuum responsive linkage in an alternate position.

A fluid indicated generally at 98 substantially fills the vacuum chamber 42 when the piston 44 is in its retracted position of FIG. 3 and has a depth approximately twice as high as the orifice 96 when the piston is in its extended position of FIG. 5. The fluid 98 preferably has a freezing temperature between 40° F. and 70° F. so as to be in a solid state when the engine is to be started and before it is warmed up, and in a liquid state when the engine is operating. This is primarily to facilitate starting the engine as described hereinbelow.

Of various suitable liquids, one example is glycerol which is a sweet syrupy hygroscopic trihydroxy alcohol $C_3H_8O_3$ which has a freezing temperature between 45° F. and 50° F. and which starts to gel at 64° F. Glycerol is non-flammable, economical, commonly available and it won't corrode the various rubber and metal elements which it contacts.

In operation, when an engine is to be started, the linkage 10 of the present invention is usually in the position of FIG. 4 wherein piston 44 is in its retracted position. Since the engine 14 is cool, the valve 86 on vacuum tube 76 is closed and the fluid 98 within the vacuum chamber 42 is in a solid state. Accordingly, when the ignition is turned on and the accelerator pedal 26 depressed, accelerator linkage 22 is pivoted forwardly from the fire wall against the action of return spring 28 to pull second rod 66 and housing 30 to the right as indicated in FIG. 5. Since the solid fluid seals the variable volume chamber 92, piston 44 is retracted with the housing to its dotted line position of FIG. 5 whereby the carburetor throttle linkage 18 is pivoted to its dotted line position in directed response to accelerator pedal movement. Likewise, since the valve 86 along vacuum tube 76 is closed, the resultant closed condition of vacuum chamber 42 resists expansion so that piston 44 would tend to be drawn to the right with the housing 30 even in the absence of fluid 98. Once the engine has warmed up, the temperature responsive valve 86 will open and the fluid 98 will melt to a liquid state for normal operation of the linkage 10 as follows.

Assuming the automobile 12 is standing still with the engine 14 warmed and idling, forward motion is initiated by stepping on the accelerator pedal 26 in the usual manner. Accordingly, housing 30 is drawn to the right as indicated in FIG. 5 and, due to the resistance of fluid flow through the orifice opening 94, piston 44 is pulled to its dotted line position of FIG. 5 by the relative vacuum within the variable volume chamber 92. During acceleration, however, the carburetor vacuum substantially falls off with the result that as fluid 98 passes through orifice 94 to variable volume chamber 92, the return spring 20 of carburetor throttle lever 18 draws the piston 44 leftward to its solid line position of FIG. 5 wherein the rate of acceleration is substantially decreased. As the load on the engine becomes less, the vacuum within carburetor 16 increases thereby increasing the vacuum within fixed volume chamber 90 to draw fluid back through orifice 94 and thereby pull piston 44 to the right to increase pivotal movement of throttle lever 18 for supplying additional fuel to the engine 14.

Thus fuel efficient operation of a vehicle is achieved independently of the driving habits of any particular operator. The lost motion which occurs between the piston 44 and housing 30 prevents prolonged jackrabbit starts when the engine is warm. At the same time, the restriction of fluid flow through orifice 94 does provide sufficient initial responsive movement of the carburetor throttle lever 18 to movement of the accelerator pedal linkage 22 as may be necessary in particular traffic situations. Generally, however, acceleration will be limited to that extent which is necessary to maintain a high vacuum within the carburetor. Since the fuel efficiency of an internal combustion engine is generally proportional to the level of vacuum produced by the engine, it is seen that the vacuum responsive carburetor linkage of the present invention thus maximizes the fuel efficiency of an internal combustion engine on which it is installed.

Whereas a preferred embodiment of the invention has been shown and described herein, it is apparent that many modifications, variations and alterations may be made within the intended broad scope of the invention as defined in the appended claims. For example, in certain embodiments the valve 86 and/or fluid 98 may be deleted with alternate means provided to facilitate starting. Likewise, it is contemplated that the vacuum responsive control of the present invention could be built into the carburetors of new engines. In such embodiments, the vacuum responsive linkage of the invention may be operatively connected between the carburetor throttle valve and accelerator pedal linkage in such a way that structure resembling the carburetor throttle lever of conventional engines may actually be part of the connection to the accelerator pedal linkage. It is apparent that the "built-in" embodiment would not be nearly as economically feasible as the embodiment of the drawings for readily modifying the engines of existing automobiles.

Whereas the preferred vacuum source is the throat of the carburetor, it will be understood that various other vacuum sources such as the engine manifold may alternately be utilized.

Installation of the linkage of the present invention on an internal combustion engine will not affect the gas to air ratio of the engine; will not add to the emissions of the engine; and may even reduce the level of emissions due to the more fuel efficient operation of the engine.

Whereas as lever 18 and throttle 82 are shown in FIGS. 4 and 5 in spaced-apart relation for clarity, it is known that these are conventionally mounted on the same shaft.

Thus there has been shown and described a vacuum responsive carburetor control which satisfies at least all of the stated objects.

I claim:

1. A vacuum responsive carburetor linkage adapted for connection between the accelerator pedal linkage and carburetor throttle lever of an internal combustion engine, comprising, a housing, said housing at least partially defining a vacuum chamber therein, a movable wall engageable with said housing and further defining said vacuum chamber, said wall being movable relative to said housing between fully extended and retracted positions such that said chamber is extended and retracted in response to movement of said wall toward said fully extended and retracted positions respectively, means for connecting said housing to one of said accelerator pedal linkage and carburetor throttle lever, means for connecting said movable wall to the other of said accelerator pedal linkage and carburetor throttle lever, and vacuum conduit means having one end in communication with said chamber and an opposite end adapted for connection to a vacuum source of the internal combustion engine, said end wall being movable toward said extended position in response to movement of said accelerator pedal linkage when the carburetor vaccum is low whereby lost motion occurs between said accelerator pedal linkage and carburetor throttle lever and said end wall being urged toward said retracted position when the carburetor vacuum is high for movement of said carburetor throttle lever in substantially direct response to movement of said accelerator pedal linkage, a stationary baffle disposed within said housing interiorly of said piston, said baffle including an orifice at a lower portion thereof for fluid communication therethrough, a liquid disposed within said housing between said one end and said piston, and said orifice being positioned adjacent a lower edge of said baffle, the level of said liquid being at least as high as said orifice, when the movable wall is in the fully extended position therefor.

2. The vacuum responsive carburetor linkage of claim 1 further comprising a heat responsive valve means interposed along said vacuum conduit means, said valve means being mounted on said engine and being responsive to engine temperature so as to open when said engine is warm and operating.

3. The vacuum responsive carburetor linkage of claim 1 wherein said opposite end of said vacuum conduit means is connected to a vacuum source in the carburetor of the internal combustion engine.

4. The vacuum responsive carburetor linkage of claim 3 wherein said vacuum source comprises the throat of the carburetor at a position upstream of the throttle valve therein.

5. A vacuum responsive carburetor linkage adapted for connection between the accelerator pedal linkage and carburetor throttle lever of an internal combustion engine, comprising, a housing, said housing at least partially defining a vacuum chamber therein, a movable wall engageable with said housing and further defining said vacuum chamber, said wall being movable relative to said housing between extended and retracted positions such that said chamber is extended and retracted in response to movement of said wall toward said extended and retracted positions respectively, means for connecting said housing to one of said accelerator pedal linkage and carburetor throttle lever, means for connecting said movable wall to the other of said accelerator pedal linkage and carburetor throttle lever, and vacuum conduit means having one end in communication with said chamber and an opposite end adapted for connection to a vacuum source of the internal combustion engine, said end wall being movable toward said extended position in response to movement of said accelerator pedal linkage when the carburetor vacuum is low whereby lost motion occurs between said accelerator pedal linkage and carburetor throttle lever and said end wall being urged toward said retracted position when the carburetor vacuum is high for movement of said carburetor throttle lever in substantially direct response to movement of said accelerator pedal linkage, said housing comprising an elongated tubular member closed at one end and opened at the opposite end, said end wall comprising a piston axially movable within said elongated tubular housing, a stationary baffle disposed within said housing interiorly of said piston, said baffle including an orifice for fluid communication therethrough, a liquid disposed within said housing between said one end and said piston, and said orifice being positioned adjacent a lower edge of said baffle, the level of said liquid being at least as high as said orifice, when the movable wall is in the extended position and said liquid having a freezing temperature between 40° F. and 70° F.

* * * * *